United States Patent [19]

Hiratsuka et al.

[11] Patent Number: 5,022,334

[45] Date of Patent: Jun. 11, 1991

[54] PRESSER BAR LIFTER IN A BUTTON PERFORATING SEWING MACHINE

[75] Inventors: Katsuo Hiratsuka; Yoshiyuki Odaka; Takayuki Sakamoto, all of Tochigi, Japan

[73] Assignee: SSMC Inc., Edison, N.J.

[21] Appl. No.: 380,402

[22] Filed: Jul. 17, 1989

[30] Foreign Application Priority Data

Aug. 18, 1988 [JP] Japan ..... 63-108609[U]

[51] Int. Cl.[5] ..... D05B 29/00

[52] U.S. Cl. ..... 112/238; 112/67

[58] Field of Search ..... 112/65, 66, 67, 68, 112/70, 74, 76, 238, 239

[56] References Cited

U.S. PATENT DOCUMENTS 1,136,388 4/1915 Allen ..... 112/67 X 1,807,577 5/1931 Allen ..... 112/68

*Primary Examiner*—Werner H. Schroeder

*Assistant Examiner*—Paul C. Lewis

*Attorney, Agent, or Firm*—Theodore Jay

[57] ABSTRACT

A stop lever fixing lever supported at a bed body of a sewing machine has one end to be contacted by a projection of a pattern wheel. A connecting member has one end connected to the other end of the stop lever fixing lever. A first presser bar lifter has one end connected to the other end of the connecting member. A second presser bar lifter has one end defining an operation arm positioned at a lifting position and has a folded projection provided with a hole. A stepped screw having a knurled thumb at the peripheral surface thereof is rotatably inserted in the hole of the folded projection edge with a small diameter screw portion at the tip end thereof. A lever shifting member is screwed into the small diameter screw portion at the folded projection edge. A presser bar lifter cam is disposed along a cutting axis and has a projection. The lever shifting member is engaged with the first presser bar lifter at one pivotable position for transmitting the swingable movement of the first presser bar lifter to the second presser bar lifter while it is engaged with the projection of the presser bar lifter cam and at the other pivotable position transmits the swingably movement of the presser bar lifter cam to the second presser bar lifter.

4 Claims, 5 Drawing Sheets

PRESSER BAR LIFTER IN A BUTTON PERFORATING SEWING MACHINE

BACKGROUND OF THE INVENTION

1. Field of the Invention:

There are two types of button perforating sewing machines. The first type (hereinafter referred to as the earlier perforation type) perforates cloth at an early step in the operation. The second type (hereinafter referred to as the later perforation type) perforates cloth at a later step in the operation.

The present invention relates to a presser bar lifter in a perforating sewing machine which can be adapted for use in either type machine.

2. Description of Prior Art:

The earlier type machine employs the following steps in succession: "SEWN CLOTH CLAMPING STEP", "BUTTON PERFORATING STEP", "CLOTH TENSIONING STEP", "FIRST FEEDING STEP", "SEWING STEP", "SECOND FEEDING STEP" and "SEWN CLOTH CLAMPING AND RELEASING STEP". The later type machine employs a different succession of steps: "SEWN CLOTH CLAMPING STEP", "CLOTH TENSIONING STEP", "FIRST FEEDING STEP", "SEWING STEP", "SECOND FEEDING STEP", "BUTTON PERFORATING STEP", and "SEWN CLOTH CLAMPING AND RELEASING STEP".

Thus, the earlier perforation type machine and the later perforation machine utilize steps which differ in the order or position of the "BUTTON PERFORATING STEP".

SUMMARY OF THE INVENTION

It is an object of the present invention to provide a presser bar lifter capable of being shifted in use either in the earlier perforation type machine or the later perforation machine by one touch operation of a lever shifting member.

It is another object of the present invention to provide a presser bar lifter which during operation can prevent damage to sewn cloth and to the sewing machine.

It is a further object of the present invention to provide a presser bar lifter which eliminates use of an instrument used solely for shifting operation from the earlier perforation type machine to the later perforation type machine as well as shifting from the later perforation type machine to the earlier perforation type machine.

It is still a further object of the present invention to provide a presser bar lifter capable of automatizing a series of operation steps.

To achieve the above objects, the presser bar lifter comprises a pattern wheel fixed to a pattern wheel axis which is supported by a bed body of a sewing machine. The wheel rotates through one revolution about the pattern wheel axis for each stitching operation cycle and has a projection positioned at the periphery thereof also rotatable through one revolution for each stitching operation. A stop lever fixing lever is supported by the bed body and has a central portion swingably supported by an axis parallel with the pattern wheel axis. One end of the stop lever fixing lever is engagable with the projection of the pattern wheel. A connecting member has one end connected to the other end of the stop lever fixing lever. A first presser bar lifter has a middle portion swingably supported by a cutting axis parallel with the pattern wheel axis. One end of the lifter is connected to the other end of the connecting member. The first presser bar lifter is always urged clockwise by a spring extended between the stop lever fixing lever and the body via the stop lever fixing lever and the connecting member. A second presser bar lifter has a middle portion swingably supported at the side of the bed body by an axis D—D' parallel with the pattern wheel axis. One end of the second lifter defines an operation arm which is disposed at the lifting position by the urging force of a spring extended between the bed body and the second presser bar lifter. The other end of the second lifter is provided with a folded projection edge inclined at the side of the operation arm edge and having a hole. A stepped screw having a knurled thumb at the peripheral surface thereof is rotatably inserted in this hole of the folded projection edge with a small diameter screw portion at the tip end thereof. A lever shifting member is screwed into the small diameter screw portion of the folded projection and has a projecting roller which is normally positioned in the recess of the second presser bar lifter. A presser bar lifter cam is secured to the cutting axis for swingably fixing the first presser bar lifter. The cam has a projection. The lever shifting member is engaged with the first presser bar lifter at a first swingable position for transmitting the swingable movement of the first presser bar lifter to the second presser bar lifter and is engaged with the projection of the presser bar lifter cam at a second swingable position for transmitting the swingably movement of the presser bar lifter cam to the second preser bar lifter.

The above and other objects, features and advantages of the present invention will become more apparent from the following description taken in conjunction with the accompanying drawings.

DESCRIPTION OF PREFERRED EMBODIMENT

Figure 1:
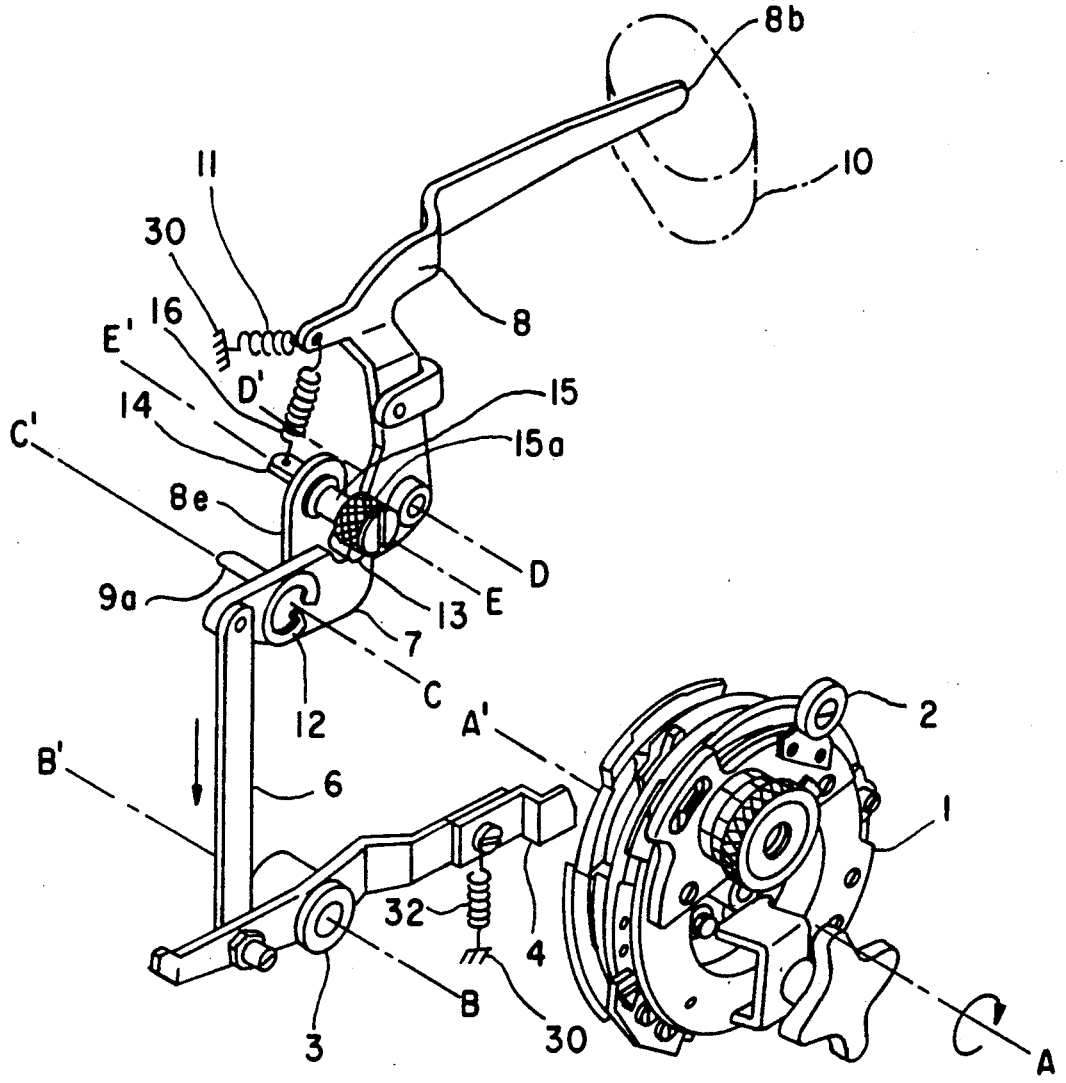
FIG. 1 is a perspective view showing a presser bar lifter according to a preferred embodiment of the present invention.
Figure 2:
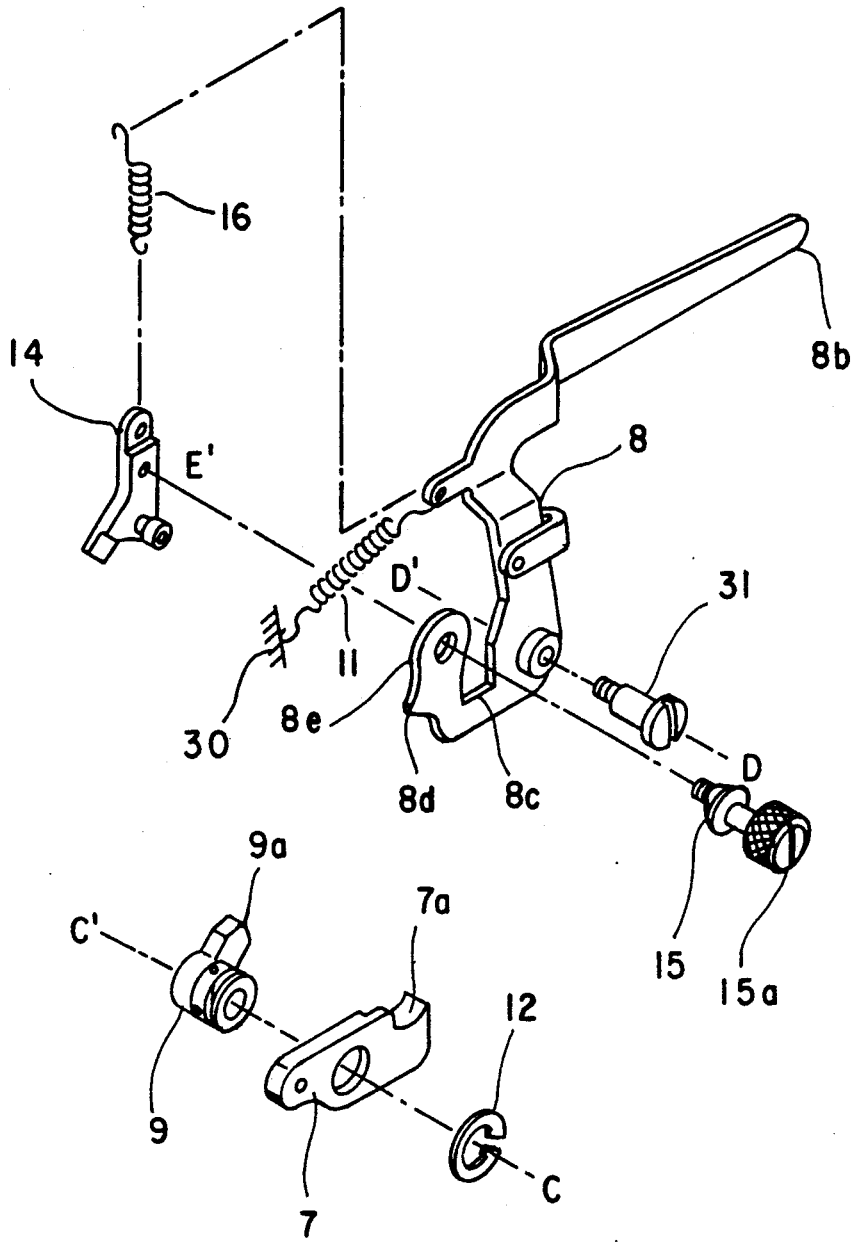
FIG. 2 is a perspective exploded view of a main portion of the presser bar lifter according to the preferred embodiment of the present invention.

A presser bar lifter according to a preferred embodiment of the present invention is described below with reference to FIGS. 1 to 4.

The presser bar lifter comprises a pattern wheel 1 disposed along a pattern wheel axis A—A' and supported on a bed body 30 of a sewing machine. The pattern Wheel is rotatable, one revolution about the pattern wheel axis A—A' for each through stitching operation cycle and has a projection 2 positioned at the periphery thereof also rotatable through one revolution for each stitching operation. A stop lever fixing lever 3 supported on the bed body 30 has a central portion pivotable about an axis B—B' parallel with the pattern wheel axis A—A'. One end of the stop lever fixing lever 3 is to be in contact with the projection 2 of the pattern wheel 1. A connecting member 6 has one end connected to the other end of the stop lever fixing lever 3. A first presser bar lifter 7 has a middle portion pivotably supported by a cutting axis C—C'. One end of lifter 7 connected to the other end of the connecting member 6. The first presser bar lifter 7 is always urged clockwise by a spring 32, extended between the stop lever fixing lever 3 and the body 30, via the stop lever fixing lever 3 and the connecting member 6. A second presser bar lifter 8 has substantially an inverse Z-shape and a middle portion pivotally supported at the side of the bed body 30 about an axis D—D' (a pin 31 in FIG. 2) parallel with the pattern wheel axis A—A'. One end of lifter 8 defines an operation arm 8*b* positioned at the lifting position by an urging force of a spring 11 extended between the bed body 30 and the second presser bar lifter 8. The other end of lifter 8 is provided with a folded projection edge 8*e* inclined at the side of the operation arm 8*b* and having hole. A stepped screw 15 having a knurled thumb 15*a* at the peripheral surface thereof is rotatably inserted in the hole of the folded projection edge 8*e* with a small diameter screw portion at the tip end thereof. A lever shifting member 14 screwed into the small diameter screw portion of the screw 15 and has a projecting roller 13 which is normally positioned in the recess 8*c* of the second presser bar lever 8. A presser bar lifter cam 9 is disposed along cutting axis C—C' for pivotably securing the first presser bar lifter 7. Cam 9 has a projection 9*a*. Lever shifting member 14 is engaged with the first presser bar lifter 7 at a first pivotable position for transmitting the pivotable movement of the first presser bar lifter 7 to the second presser bar lifter 8. Member 14 is engaged with the projection 9*a* of the presser bar lifter cam 9 at a second pivotable position for transmitting the pivoting movement of the presser bar lifter cam 9 to the second presser bar lifter 8.

Figure 3:
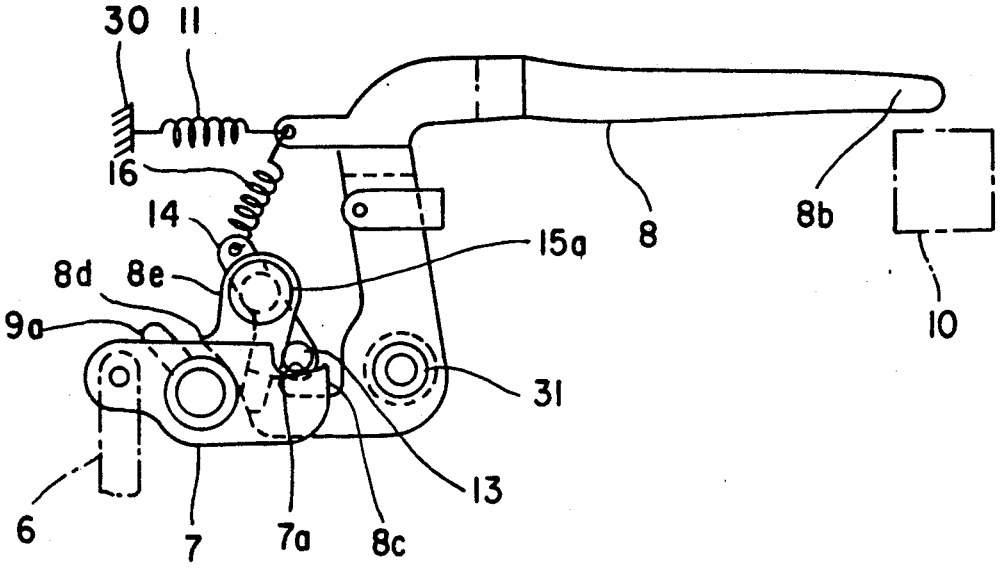
FIGS. 3 and 4 illustrate different operations of the present bar lifter according to the preferred embodiment of the present invention.

The first presser bar lifter 7 has a recess 7*a* at the end thereof for holding the projection 13 in the condition at which the lever shifting member 14 is swung in one side as illustrated in FIG. 3 whereby the movement of the first presser bar lifter 7 is transmitted to the second presser bar lifter 8 via the lever shifting member 14. The projection 13 is held by the projection 9*a* of the presser bar lifter cam 9 in the state at which the lever shifting member 14 is rotated in the other side whereby the movement of the projection 9*a* is transmitted to the second presser bar lifter 8 via the lever shifting member 14.

The stepped screw 15 can fix the lever shifting member 14 by providing two surface width or a spline connection.

An operation of the presser bar lifter according to the preferred embodiment is described below.

When the presser bar lifter in the button perforating sewing machine is used as the earlier perforation type machine, the knurled thumb 15*a* is rotated to permit the projection 13 of the lever shifting member 14 to be held by the recess 7*a* of the first presser bar lifter 7 as shown in FIG. 3. As a result, the "SEWN CLOTH CLAMPING AND RELEASING STEP" can be carried out in the same manner as the prior art presser bar lifter adapted for sole use in the earlier perforation type machine. The pattern wheel 1 is rotated for processing "SECOND QUICK FEEDING STEP" and the second projection 2 contacts the contact member 4 of the tip end of the stop lever fixing lever 3 whereby the stop lever fixing lever 3 swings about the axis B—B' against the tension force of the return spring 32 to lower the connecting member 6 and permit the first presser bar lifter 7 to swing about the cutting axis C—C'. At this point, the projection 13 of the lever shifting member 14 is held in the recess 7*a* of the first presser bar lifter 7 and is pressed upward along the bent election edge 8*e* whereby the second presser bar lifter 8 swings against tension force of the return spring 11 to lower the operation arm 8*b*. With lower movement of the operation 8*b*, the cam pushing down the clamping unit 10 is contacted and rotated to release the clamping unit 10 whereby the sewn cloth on the base plate (not shown) is released from the clamping state.

According to the present embodiment which differs from the presser bar lifter adapted for sole use in the prior art earlier perforation type machine the presser bar lifter cam 9 is disposed along the cutting axis C—C' so that the presser bar lifter cam 9 is rotated one revolution at the "BUTTON PERFORATING STEP" in an initial state of the stitching sewing cycle of the earlier perforation type machine. At that time, since as the projection 9*a* of the presser bar lifter cam 9 does rotate or runs idle between the first and second presser bar lifters 7, 8, the "SEWN CLOTH CLAMPING AND RELEASING STEP" (wherein the operation arm 8*b* of the second presser bar 8 is lowered) is not carried out.

When the presser bar lifter is used in the later perforation type machine, the thumb 15*a* is caused to rotate counterclockwise from the state as shown in FIG. 3 to permit the projection 13 of the lever shifting member 14 to be held by the inclined 8*d* of the second presser bar lifter 8 while the position "SEWN CLOTH CLAMPING AND RELEASING STEP" can be effected in the same way as the pressure bar lifter adapted for sole use in the prior art later perforation type machine. After the presser bar lifter cam 9 is rotated one revolution about the cutting axis C—C' at the "BUTTON PERFORATING STEP" and the sewn cloth is subjected to the button perforating operation by a cutter (not shown), the projection 9*a* is moved to push up the projection 13 of the lever shifting member 14 thereby rotating the second presser bar lifter 8 about the axis D—D' against the tension force of the return spring 11, thus lowering the operation arm 8*b*. At this point, the projection 13 of the lever shifting member 14 is held by the projection 9*a* of the presser bar lifter 9 and pushed up along the folded projection edge 8*e*.

The lowering movement of the operation arm 8*b* releases the clamping unit in the same operation as the aforementioned earlier perforation type machine.

Figure 4:
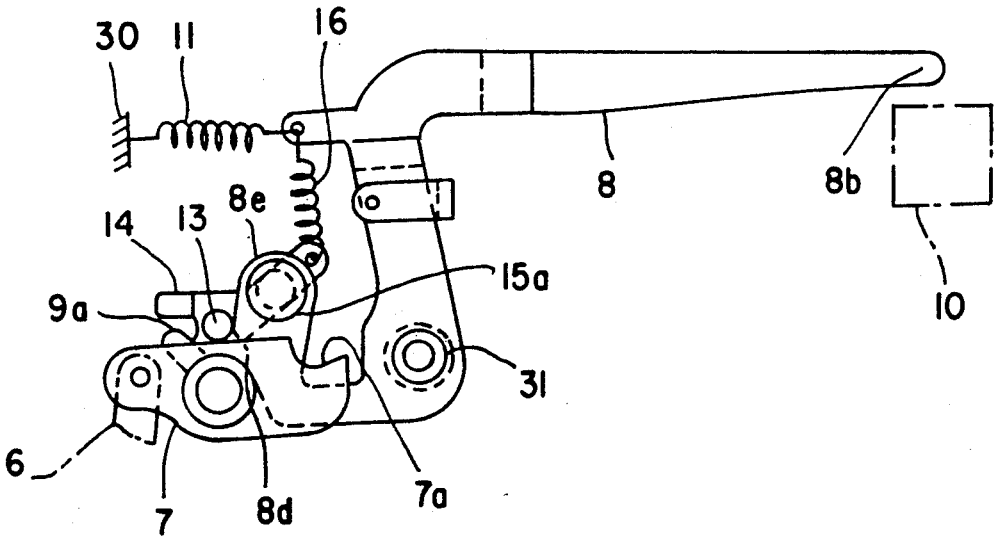
Figure 5:
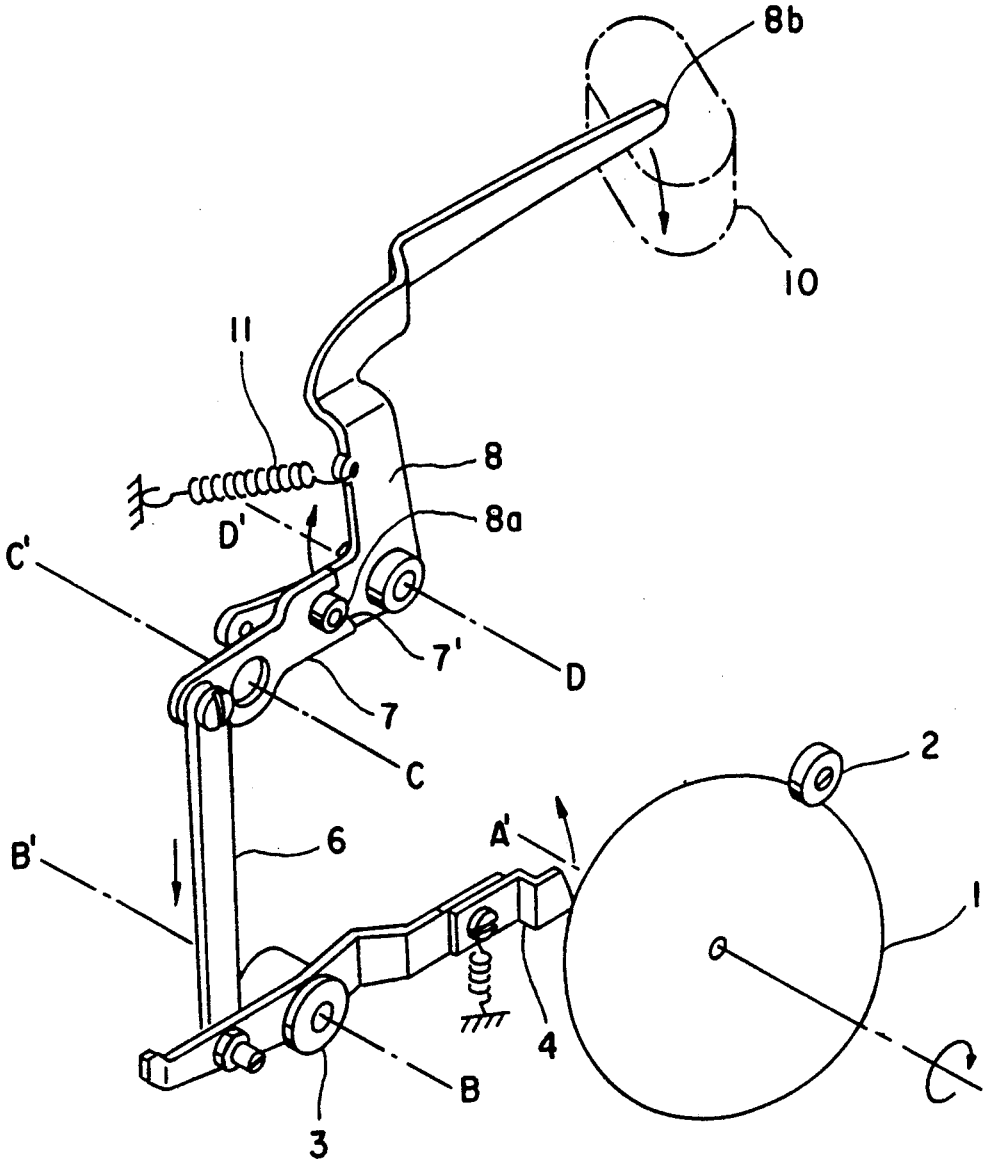
PRIOR ART Fig. 5
FIG. 5 is a perspective view of a presser bar lifter of a prior art earlier perforation type.
Figure 6:
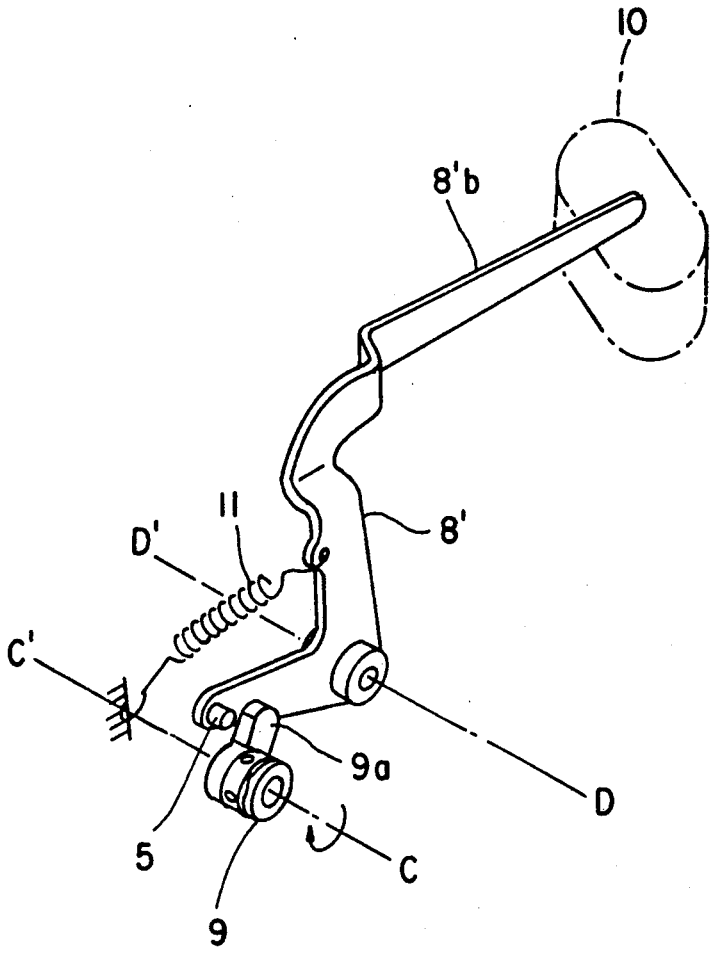
PRIOR ART Fig. 6
FIG. 6 is a perspective view of a presser bar lifter of a prior art later perforation type.

According to the present embodiment, since the first presser bar lifter 7 is swingably supported by the presser bar lifter cam 9 disposed along the cutting axis C—C', the pattern wheel 1 is rotated for "SECOND FEEDING PROCESS" so that the projection 3 engages or contacts the contact member at the tip of the stop lever fixing lever 3 to swing the first presser bar lifter 7. However, since the shifting lever 14 is in a position as illustrated in FIG. 4 at that time, the second presser bar 8 is not operated by the pivotable movement of the first presser bar lifter 7 so that the clamping unit 10 can not be released until "BUTTON PERFORATING STEP".

According to this preferred embodiment, when the lever shifting lever 14 is swung to the other side, the projection 13 is held by the inclined projection 8*d* of the second presser bar lifter 8. However, if the projection 13 is caused to substantially accord with the swingable center of the first presser bar lifter 7, even if the projection 13 is held by the upper surface of the first presser bar lifter 7 the projection 13 is hardly affected by the swingable movement of the first presser bar lifter 7. That is, when the second presser bar lifter 8 is swingably driven by the movement of the first presser bar lifter 7, a mechanism can be provided which does not release the clamping unit 10.

The presser bar lifter in a button perforating sewing machine has the following advantages.

(1) The presser bar lifter according to the present invention, namely, the device for actuating the device for releasing the clamping unit can be shifted to the earlier perforation type machine usage or to the later perforation type usage by mere one touch operation of the lever shifting member. Thus, the presser bar lifter can be shifted to the earlier perforation type or later perforation type with a simple structure and a simple operation in a short period of time.

(2) Since the presser bar lifter can be shifted to the earlier or the later perforation type by a mere shifting operation, the shifting operation of a plurality of shifting portions can not be forgotten or omitted by the operator, thus preventing accidental damage to the sewn cloth and the sewing machine.

(3) It is not necessary to use an instrument having the sole use of shifting to the earlier perforation machine type or to the later perforation type machine since such instrument is not needed for shifting the lever shifting member.

(4) It makes possible with ease to automize a series of operation steps since in the button perforating sewing machine which can be used either as the earlier perforation type machine or the later perforation type machine, a sensor can detect the swingable position of the lever shifting member and issues a signal based on which a series of operation steps can be shifted to the earlier perforation type machine and the later perforation type machine.

Although the invention has been described in its preferred form with a certain degree of particularity, it is to be understood that many variations and changes are possible in the invention without departing from the scope thereof.

What is claimed is:

1. A presser bar lifter in a button perforating sewing machine comprising:

a pattern wheel fixed to a pattern wheel axis supported by a bed body of said sewing machine and rotatable through one revolution about the pattern wheel axis for each stiching operation cycle, said wheel having a projection positioned at a periphery thereof also rotatable through one revolution for each stitching operation;

a stop lever fixing lever supported by the bed body and having a central portion swingably supported by an axis parallel with the pattern wheel axis; one end to be kicked by the projection of the pattern wheel;

a connecting member having one end connected to another end of the stop lever fixing lever;

a first presser bar lifter having a middle portion swingably supported by a cutting axis parallel with the pattern wheel axis, one end connected to another end of the connecting member, the first presser bar lifter being always urged clockwise by a spring, extended between the stop lever fixing lever and the body, via the stop lever fixing lever and the connecting member;

a second presser bar lifter having a middle portion swingably supported at a side of the bed body by an axis parallel with the pattern wheel axis, one end defining an operation arm so as to be positioned at a lifting position by an urging force of a spring extended between the bed body and the second presser bar lifter, the other end provided with a folded projection inclined at a side of the operation arm and having a through hole;

a stepped screw having a knurled thumb at a peripheral surface thereof rotatably inserted in the through hole of the folded projection and a small diameter screw portion at a tip end thereof;

a lever shifting member screwed into the small diameter screw portion of the folded projection and having a projecting roller normally positioned in a recess of the second presser bar lever;

a presser bar lifter cam fixed to the cutting axis for swingably fixing the first presser bar lifter and having a projection;

the lever shifting member being engaged with the first presser bar lifter at one swingable position for transmitting the swingable movement of the first presser bar lifter to the second presser bar lifter and engaged with the projection of the presser bar lifter cam at another swingable position for transmitting the swingable movement of the presser bar lifter cam to the second presser bar lifter.

2. A presser bar lifter according to claim 1, wherein the first presser bar lifter has a recess at the end thereof for holding the projection at a state where the lever shifting member is swung in one swingable position whereby a movement of the first presser bar lifter is transmitted to the second pressor bar lifter via the lever shifting member.

3. A presser bar lifter according to claim 1, wherein the projection is held by the projection of the presser bar lifter cam at a state where the lever shifting member is swung in other swingable position whereby a movement of the projection is transmitted to the second presser lifter via the lever shifting member.

4. A presser bar lifter according to claim 1, wherein the stepped screw can fix the lever shifting member by a spline connection.

* * * * *